United States Patent [19]

Ohki

[11] 4,303,242

[45] Dec. 1, 1981

[54] TOY FOR PLAYING BASEBALL GAME

[76] Inventor: Masaharu Ohki, 13-17-208, Ichikawa Minami 3-chome, Ichikawa-shi, Chiba-ken, Japan

[21] Appl. No.: 169,507

[22] Filed: Jul. 21, 1980

[51] Int. Cl.[3] ..... A63F 7/06

[52] U.S. Cl. ..... 273/93 R; 273/143 R

[58] Field of Search ..... 273/93 R, 94, 143 R

[56] References Cited

U.S. PATENT DOCUMENTS

| | | | |
|---|---|---|---|
| 1,171,916 | 2/1916 | Akins | 273/93 R |
| 2,026,048 | 12/1935 | Kroff | 273/93 R |
| 2,061,221 | 11/1936 | Craig | 273/93 R X |
| 2,134,461 | 10/1938 | Fusco | 273/93 R X |
| 2,388,577 | 11/1945 | Shenker | 273/93 R |
| 2,626,155 | 1/1953 | Beierle | 273/143 R X |
| 3,022,075 | 2/1962 | Danner | 273/93 R |
| 4,198,052 | 4/1980 | Gauselmann | 273/143 R |

*Primary Examiner*—George J. Marlo

*Attorney, Agent, or Firm*—Steinberg & Raskin

[57] ABSTRACT

There is provided a toy for playing the baseball game. The toy for playing the baseball game consists of a main body of the toy and a cover member for covering the main body. The main body includes; a first rotary member bearing on the outer surface thereof plural displays for displaying the kind of pitching and the kind of offense in the baseball game; a second rotary member bearing on the outer surface thereof plural displays for displaying the kind of fielding in the baseball game; driving elements for rotating said first and second rotary members in the interlocking arrangement with each other; first stopping elements for stopping the rotation of said first rotary member; and second stopping elements for stopping the rotation of said second rotary member; and said cover member includes: a first window allowing the players to see therethrough one display of said displays on said first rotary member; a second window allowing the players to see therethrough one display of said displays on the first rotary member; and a plurality of third windows, each allowing the players to see therethrough one display of said displays on said second rotary member.

10 Claims, 15 Drawing Figures

TOY FOR PLAYING BASEBALL GAME

BACKGROUND OF THE INVENTION

This invention relates to a toy for playing the baseball game. More specifically, the present invention relates to a toy for playing the baseball game which toy makes it possible to play the baseball game without using a ball in accordance with the rule of the baseball game by displaying at random characters or symbols corresponding to the pitching result of the pitcher, the batting content of the batter for the pitched ball and the fielding position in the direction of the hit ball on display windows formed on a cover of a main body of the toy and by also displaying at random characters or symbols corresponding to the fielding results or the batting results on plural display windows disposed at positions corresponding to the positions of the fielders in the baseball game.

There have conventionally been known various toys for playing the baseball game. Since all of them have such a construction wherein a ball is delivered on the game board and is mechanically hit, the mechanism becomes inevitably complicated and hence, is apt to cause troubles. Moreover, they are difficult to economically produce and to offer really elaborate and interesting progress of the game as in the real baseball game to the players.

SUMMARY OF THE INVENTION

It is therefore an object of the present invention to provide a toy for playing the baseball game which toy has a simple construction and is free from mechanical troubles.

It is another object of the present invention to provide a toy for playing the baseball game which toy makes it possible for the players to play the baseball game without using a ball.

It is still another object of the present invention to provide a toy for playing the baseball game which makes it possible for the players to elaborately enjoy the baseball game.

It is further an object of the present invention to provide a toy for playing the base ball game which toy can be economically produced.

In other words, the present invention relates to a toy for playing the baseball game consisting of a main body of the toy and a cover member for covering the main body, wherein said main body includes a first rotary member bearing on the outer surface thereof plural displays for displaying the kind of pitching in the baseball game and plural displays for displaying the kind of offense in the baseball game; a second rotary member bearing on the outer surface thereof plural displays for displaying the kind of fielding in the baseball game; driving means for rotating said first and second rotary members in the interlocking arrangement with each other; first stopping means for stopping the rotation of said first rotary member; and second stopping means for stopping the rotation of said second rotary member; and said cover member includes a first window allowing the players to see therethrough one display of said displays on said first rotary member for displaying the kind of pitching; a second window allowing the players to see therethrough one display of said displays on said first rotary member for displaying the kind of offense; and a plurality of third windows, each allowing the players to see therethrough one display of said displays on said second rotary member.

The toy for playing the baseball game in accordance with the present invention is played as the player(s) stops the rotation of two rotary members, that are rotated at a high speed by driving mechanisms disposed inside the main body in the interlocking arrangement with each other, simultaneously or with a suitable time lag by operating two independent stopping mechanisms so as to display the content of the progress of the baseball game in terms of characters or symbols put on the outer surfaces of the rotary members through display windows bored on the cover of the main body. By repeating this operation, the player can play and enjoy the progress of the baseball game in the same way as in the actual baseball game.

The first rotary member of the abovementioned rotary members is a rotary drum. This rotary drum consists of a first drum equipped with characters or symbols representing the kind of pitching such as "strike", "ball", "dead ball" and so forth around its circumferential surface in the rotating direction with a predetermined pitch and a second drum equipped with characters or symbols representing the batting content such as "wide swing", "foul" and so forth and the kind of offense such as the positions of the fielders, e.g., "short stop", "center fielder", "first Baseman" and so forth to which the ball is regarded as being hit, around its circumferential surface in the rotating direction with the abovementioned predetermined pitch. The second rotary member is a disc. On a concentric circle on the surface of this disc are disposed plural displays representing the results of batting such as "single hit", "out", "home run" and so forth in terms of characters or symbols with a predetermined pitch.

BRIEF DESCRIPTION OF THE DRAWINGS

In order for the present invention to be more clearly appreciated, reference is to be had to the following description in conjunction with the accompanying drawings, in which.

DETAILED DESCRIPTION OF THE PREFERRED EMBODIMENTS

Figure 1:
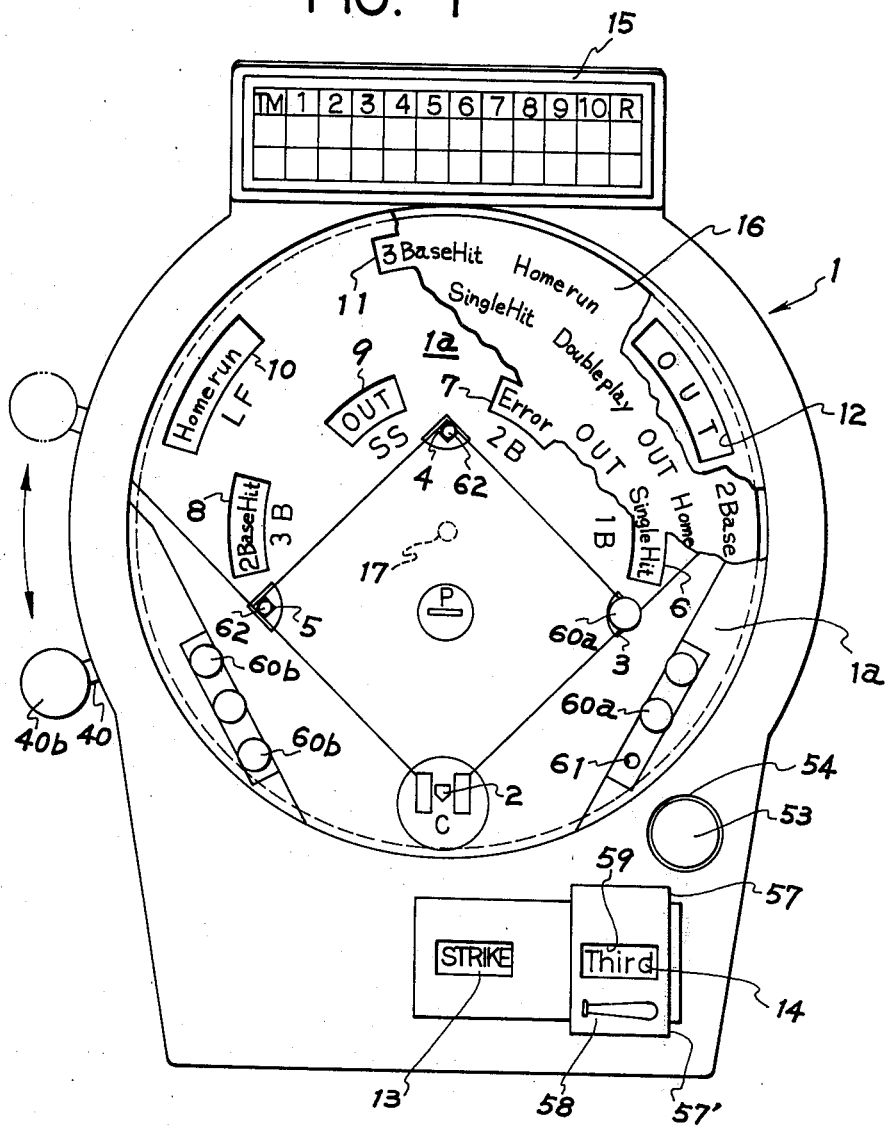
FIG. 1 is a partially sectional plan view of an embodiment of the present invention.
Figure 2:
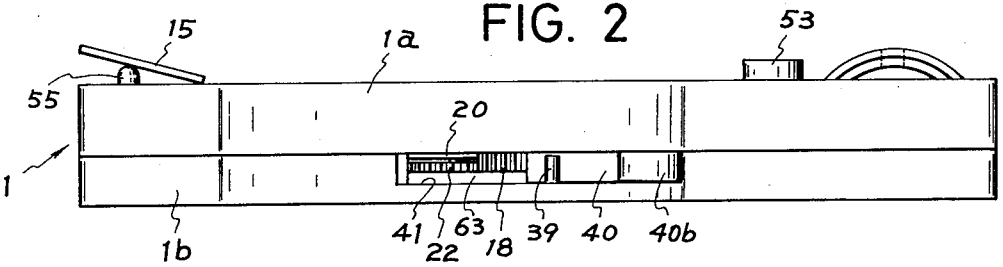
FIG. 2 is a left-hand side view of FIG. 1.

In FIGS. 1 and 2, there is shown an embodiment of the toy for playing the baseball game constructed in accordance with the present invention.

In these drawings, a game board 1 is divided into a cover 1*a* bearing the baseball ground on its surface and a base 1*b* for placing thereon the main body of the toy. On the cover 1*a* are displayed home base, first base, second base and third base 2, 3, 4, 5 and fielding positions of fielders P, C, 1B, . . . , CF, RF, LF. Fielding record display windows 6, 7, . . . , 12 are bored at portions in the proximity of the fielding positions of the fielders, respectively. Though the display windows are not shown bored at the positions of the pitcher and catcher, it is preferred to bore the windows at positions in the proximity of them in the same way as the other fielders. At the front part of the game board 1 are bored a window 13 for displaying the pitching content of the pitcher and a window 14 for displaying the batting content of the batter. A scoreboard 15 is tiltably fitted at the tip portion of the game board opposite these windows 13, 14 by means of which will be explained hereinafter.

Next, display mechanisms for the abovementioned display windows 6, 7, . . . , 14 will be explained. On the back side of the cover 1*a* of the game board 1, a display disc 16 as a fielding content display having a size substantially equal to the cover 1*a* is rotatably fitted by means of a shaft 17. Symbols or characters such as "out", "error", "hit", "double" and so forth are put around the same circumference of the disc 16 with a predetermined pitch at positions facing the display windows 6, 7, . . . , 12, respectively.

Figure 5:
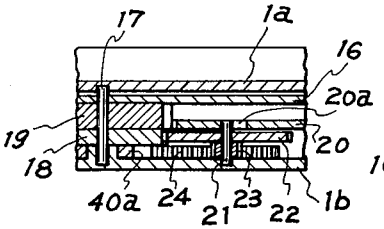
FIG. 5 is a sectional view taken along line V—V of FIG. 3.
Figure 3:
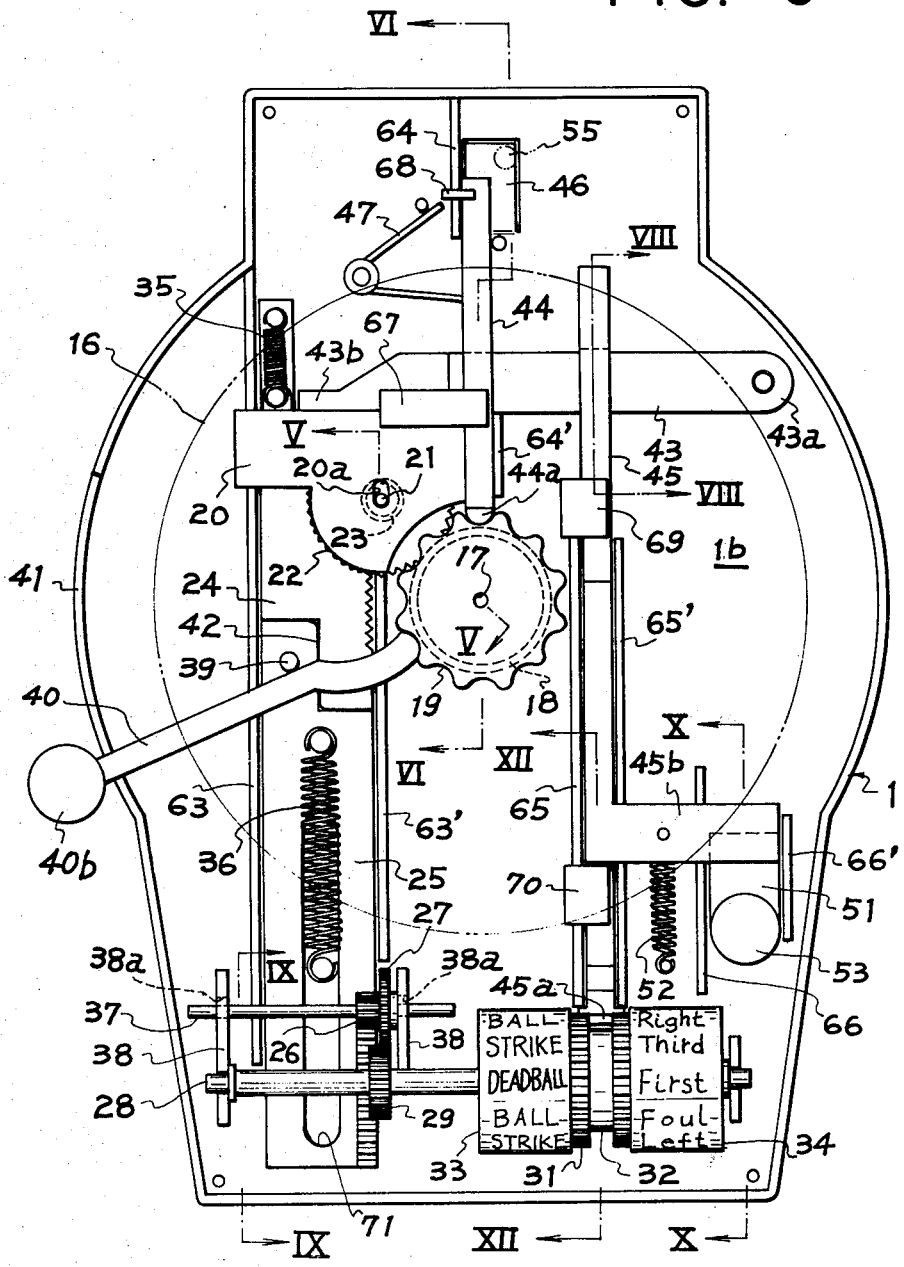
FIG. 3 is a plan view of the internal construction of the main body of an embodiment of the present invention.
Figure 4:
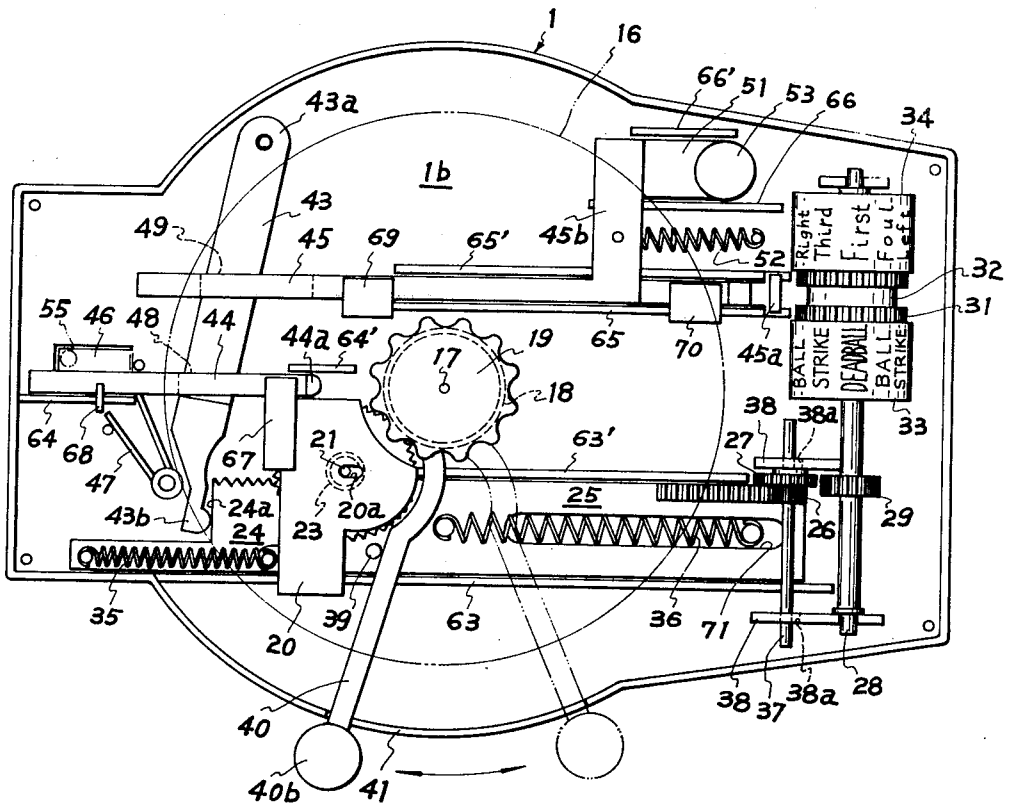
FIG. 4 is a plan view of the construction of FIG. 3 in the operative state.

As illustrated in FIGS. 3 through 5, a follower gear 18 and a control gear 19 are fitted onto the display disc 16 concentrically and integrally with the disc 16. The control gear 19 has a toothed face pitched in the same pitch as that of the symbols or characters of the abovementioned disc 16. The follower gear 18 engages with a driving gear 22 supported by a shaft 21 onto the machine frame 20 and a pinion 23 coaxial with this driving gear 22 engages with a follower rack 24 which is slidably fitted to the base 1*b* of the game board 1. On the other hand, a pinion 26 engaging with a driving rack 25, which is capable of coming into contact (normally kept in contact) with the follower rack 24, engages with a gear 29 on a rotary axle 28 via an intermediate gear 27. Two display drums 33, 34 having a control gear 32 which has a toothed face 31 with a predetermined pitch are fixed to the rotary axle 28. One 33 of the drums is positioned immediately below the display window 13 for displaying the kind of the pitched ball (see FIG. 1) while the other 34 is positioned immediately below the display window 14 for displaying the kind of offense (see FIG. 1). Plural symbols or characters representing the kind of the pitched balls such as "ball", "strike", "dead ball" and the like are displayed on the circumferential surface of the display drum 33 in its rotating direction with a pitch corresponding to the pitch of the toothed face 31 of the control gear 32, and plural symbols or characters representing the kind of offense such as "first", "third", "left" and the like are displayed on the display drum 34 in its rotating direction with a pitch corresponding to the pitch of the toothed face 31 of the control gear 32. According to this arrangement, one display of each of the abovementioned symbols or characters appears in each of the aforementioned display windows 6, 7, . . . , 12, 13, 14.

Return springs 35, 36 are hooked onto the follower rack 24 and the driving rack 25, respectively, whereby the return spring 36 of the driving rack 25 is stronger than the return spring 35 of the follower rack 24 so that when both racks 24, 25 return, the driving rack 25 is allowed to rapidly return, thereby rotating the display drums 33 and 34 at a high speed. The axle 21 of the pinion 23 is idly supported by each elongated hole 20*a* bored on the machine frame 20 and the base 1*b* at a corresponding position while the axle 37 of the pinion 26 is idly supported by each elongated hole 38*a* bored on both bearing plates 38. At the start of operation of the driving rack 25 and follower rack 24, that is, at the time of sliding of both racks 24, 25 in the leftward direction as viewed in FIG. 4, both axles 21, 37 move leftwardly in FIG. 4 so that the force of rotation of the pinions 23, 26 is not transmitted to the display disc 16 and to the display drums 33, 34.

An intermediate portion of a lever 40 strikes a pin-like engaging portion 39 formed protrusively on the driving rack 25 and the base end 40*a* of this lever 40 is pivoted to the lower support portion of the shaft 17 to which the display disc 16 is fitted. The free end 40*b* of the lever 40 protrudes outwardly from an elongated slit 41 formed on the side wall of the game board 1. Thus, the free end 40*b* is formed so as to function as a knob. Accordingly, when the lever 40 is manually rotated, the driving rack 25 is actuated and is permitted to slide together with the follower rack 24. At the time of their return due to the action of the return springs 35, 36, the force of their rotation is transmitted to the display disc 16 and to the display drums 33, 34. Incidentally, reference numeral 42 designates a butt edge that is capable of connecting the driving rack 25 to the follower rack 24.

One end 43*a* of a rotary arm 43 is pivoted onto the base 1*b* of the game board 1 while its other end 43*b* strikes the tip 24*a* of the follower rack 24. Two stoppers 44, 45 are slidably fitted onto the base 1*b* with a predetermined gap between them so as to cross the rotary arm 43 and to engage with the rotary arm 43, respectively. Namely, as illustrated also in FIGS. 6 and 7, the tip 44*a* of one (44) of the stoppers is capable of engaging with the control gear 19 on the side of the display disc 16 and a hook portion formed at its base end 44*b* is capable of engaging with a resilient anchor plate 46 disposed on the base 1*b* in such a manner as to incline upwardly. The return spring 47 is interposed between the stopper 44 and the base 1*b* (see FIG. 4). This stopper 44 is capable of engaging with the rotary arm 43 through its anchor groove portion 48 formed on its lower surface. The tip 45*a* of the other stopper 45 is capable of engaging with the control gears 32 of the display drums 33, 34 and the stopper 45 itself is capable of engaging with the rotary arm 43 via an anchor groove portion 49 formed on the lower surface of the stopper 45 as also illustrated in FIG. 8.

Figure 10:
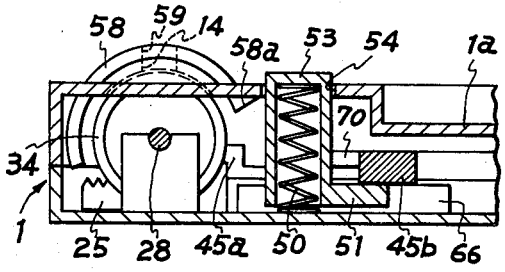
FIG. 10 is a sectional view taken along line X—X of FIG. 3.
Figure 11:
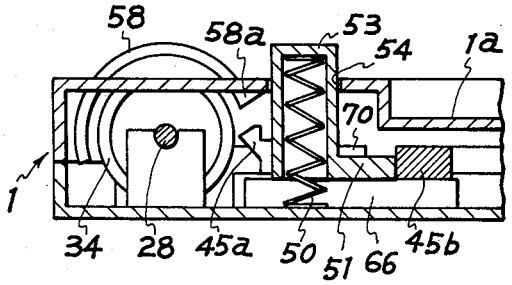
FIG. 11 is a sectional view of the construction of FIG. 10 in the operative state.
Figure 12:
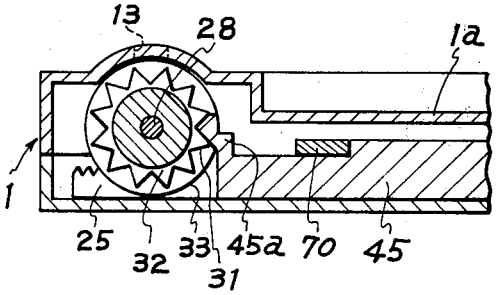
FIG. 12 is a sectional view taken along line XII—XII of FIG. 3.
Figure 13:
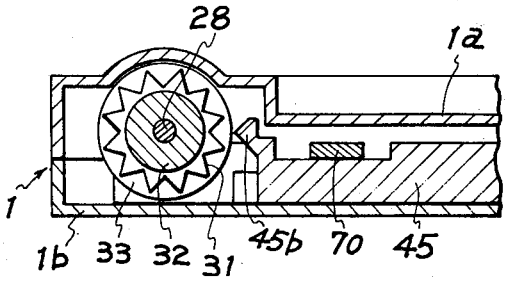
FIG. 13 is a sectional view of the construction of FIG. 12 in the operative state.

Further, an anchor arm 45*b* is formed at the intermediate portion of the stopper 45 so as to protrude transversely and a lock plate 51 subjected to the action of the return spring 50 is capable of engaging with this anchor arm 45*b* as shown in FIGS. 10 and 11, thereby making it possible to control the return operation of the stopper 45 having the return spring 52 hooked between it and the base 1*b* (see FIG. 4). The lock plate 51 is formed protrusively at the lower end portion of a push button 53 having a cylindrical hollow shape and the abovementioned return spring 50 is interposed to extend between the push button 53 and the base 1*b*. A part of the push button 53 protrudes beyond an aperture 54 bored on the cover 1*a* of the game board 1 and when depressed, the push button 53 releases the engagement between the lock plate 51 and the anchor arm 45*b*.

Figure 6:
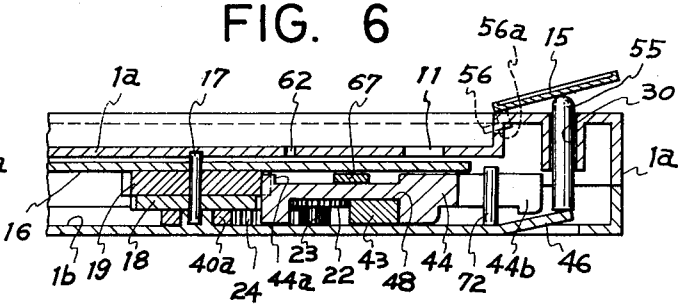
FIG. 6 is a sectional view taken along line VI—VI of FIG. 3.
Figure 7:
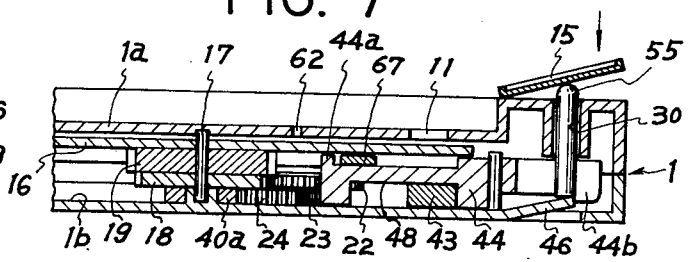
FIG. 7 is a sectional view of the construction of FIG. 6 in the operative state.
Figure 8:
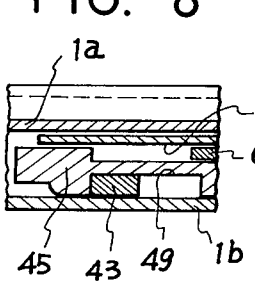
FIG. 8 is a sectional view taken along line VIII—VIII of FIG. 3.

A push rod 55 is inserted through a guide hole 30 bored on the cover 1*a* of the game board 1 between the anchor plate 46 disposed on the base 1*b* and the score board 15, as illustrated in FIGS. 6 and 7. The scoreboard 15 is kept in the inclined state as shown in FIGS. 6 and 7 by the anchor plate 46 which normally inclines upwardly. The scoreboard 15 is pivoted onto the game board as pawl plates 56 formed on the lower side are inserted into apertures 56*a* bored on the cover 1*a*. The upper end of the push rod 55 comes into contact with the lower surface of the scoreboard 15.

Figure 9:
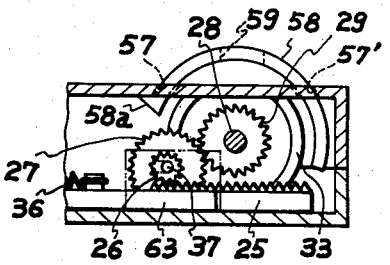
FIG. 9 is a sectional view taken along line IX—IX of FIG. 3.

The display window 14 for displaying the kind of offense is opened or closed by a substantially hemispherical shutter 58 which is fitted into a pair of front and back elongated guide holes 57, 57′ formed on the cover 1*a* of the game board 1 as shown in FIG. 9 and which is capable of rotation. A display window 59 capable of coming into conformity with the display window 14 is bored on this shutter 58. Accordingly, when the display window 59 is brought into conformity with the display window 14 as the shutter 58 is rotated, the display on the display drum 34 is permitted to appear.

Figure 14:
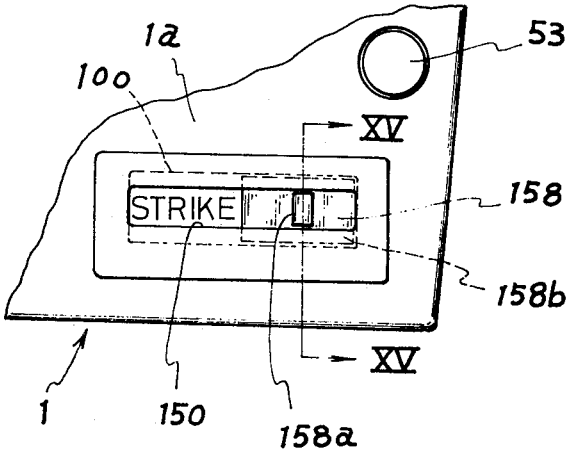
FIG. 14 is a plan view of the display window portion of another embodiment of the present invention.
Figure 15:
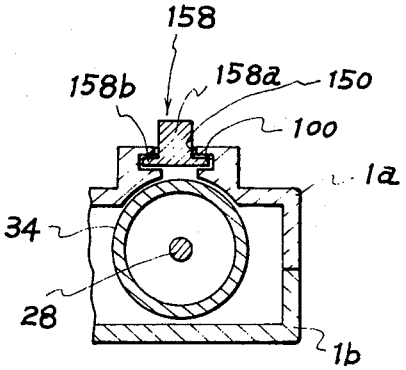
FIG. 15 is a sectional view taken along line XV—XV of FIG. 14.

FIGS. 14 and 15 show another embodiment of the display window and the shutter. In this embodiment, the window allowing to see therethrough the display representing the kind of pitching and the window allowing to see therethrough the kind of offense are formed as a common elongated window 150 on the cover 1*a* and a shutter 158 capable of selectively closing the half surface of this elongated window 150 is provided to the window 150. The shutter 158 consists of a knob 158*a* and a flange 158*b*, the flange 158*b* being fitted into an elongated groove 100 formed on the cover 1*a* having the elongated window 150 bored thereon. When the shutter 158 is slid in the direction of the axle 28, the display representing the kind of pitching or representing the kind of offense, that is put onto the outer surfaces of the display drums 33, 34, can be seen selectively through the elongated window 150.

Incidentally, in FIG. 1, reference numerals 60*a*, 60*b* designate dolls as the fielders that are fitted into insertion holes 61 bored on the side of the first base and on the side of the third base on the cover 1*a* of the game board 1, respectively. Similarly, insertion holes 62 are bored at the first, second and third bases 3, 4, 5, respectively.

As the present invention has the above-described construction, the baseball game is played in the following manner. First, the fielding party and the batting party are decided. At first, the player of the fielding team operates and rotates the lever 40 so as to simultaneously rotate the display disc 16 as well as the display drums 33, 34. In this case, the shutter 58 is operated to open or close the display window 14 representing the kind of offense on the side of the display drum 34. For the progress of the game, if the player decides to bat, the display window 59 of the shutter 58 is made to coincide with the display window 14. On the other hand, when the lever 40 is operated, the rotary arm 43 engages with each anchor groove 48, 49 of the stopper 44, 45 so that both stoppers 44, 45 slide in the leftward direction as viewed in FIG. 4. At this time, the axles 21 and 37 of the pinions 23 and 26 move leftwardly inside the elongated holes 20*a* and 38*a* in FIG. 4, respectively, so that the force of rotation is not transmitted to the display disc 16 and to the display drums 33, 34. When the lever 40 is made free, the driving rack 25 and the follower rack 24 start returning owing to the action of the springs 36 and 35, respectively, whereby the display disc 16 and the display drums 33, 34 are applied with the force of rotation and start rotating simultaneously.

When the driving rack 25 and the follower rack 24 complete their return, the force of rotation of the display drums 33, 34 and the display disc 16, that keep rotating due to the inertia, is fed back to the pinions 26 and 23 via the gears 29, 27 and the gears 18, 22, respectively, whereby the axles 21, 37 of the pinions 23, 26 escape leftwardly inside the elongated holes 20*a*, 38*a* in FIG. 4, respectively. Accordingly, the rotation of the display drums 33, 34 and the display disc 16 becomes free and they are capable of keeping further rotation due to the inertia. Both stoppers 44, 45 engage with the anchor plate 46 and the lock plate 51 at the aforementioned sliding positions, respectively, and are thus prevented from returning further.

Next, when the batting party depresses the push button 53, the engagement between the anchor arm 45*b* of the stopper 45 and the lock plate 51 of the push button 53 shown in FIG. 11 is released as shown in FIG. 10 whereby the stopper 45 is permitted to immediately return by the return spring 52, checks the control gear 32 and thus stops the rotation of both display drums 33 and 34. Simultaneously with, or slightly after, the operation of this push button 53, the fielding party pushes the scoreboard 15 in the direction of arrow in FIG. 7, whereby the anchor plate 46 is pushed and the engagement between the base end 44*b* of the stopper 44 and the anchor plate 46 shown in FIG. 7 is released as shown in FIG. 6. Hence, the stopper 44 is permitted to immediately return by the return spring 47, checks the control gear 19 and thus stops the display disc 16.

When the display disc 16 and both display drums 33, 34 stop, one display of the kind of pitching, the kind of offense and the kind of fielding appears on each display window 6, 7, . . . , 12, 13, 14. In the case shown in FIG. 1, for example, the kind of pitching is "strike" and the batter hits the ball towards the third baseman. Since the fielding content of the third baseman displays "2BH", or "double", the batter is entitled to take the second base 4. In this manner, the batting can be made till the out count becomes three in the same way as in the actual baseball. When the batter intends to miss the ball, or, does not want to bat the ball, the shutter 58 is rotated before the operation of the lever 40, in order to close the display window 14 representing the kind of offense. In this case, the push button 53 is depressed after the lever 40 is operated, to stop the display drums 33, 34. The batting count is decided by viewing only the displays appearing on the display window 13 of the kind of pitching. Incidentally, the batting party fits the doll 60*a* or 60*b* into each insertion hole 62 of each base 3, 4, 5 to play the game when the batter gets or advances to each base.

Both stoppers 44, 45 to be actuated by the rotary arm 43 are capable of engaging with the rotary arm 43 via the elongated anchor grooves 48, 49. Accordingly, when one of the stoppers, for example, the stopper 45, first returns upon operation of the push button 53, the rotary arm 43 is allowed to also return together with this stopper 45 without exerting any influence on the other stopper 44. Accordingly, it is possible to optionally select the sequence of depressing the push button by simultaneously pushing the push button 53 and the scoreboard 15, for example.

Though the display drums 33, 34 are constructed separately from each other, they may be modified into a single drum. Similarly, though the driving rack 25 and the follower rack 24 are constructed separately in the abovementioned embodiment, they may be formed integrally within the range of modification of design. Further, it is possible to make use of a motor as the driving source. If the display disc 16 and both display drums 33, 34 are allowed to frictionally rotate relative to the axles, variation is applied to their rotation and expectancy of the progress of the game may be thus diversified in an effective manner.

Incidentally, reference numerals 63, 63' in the drawing represent guide ribs for the racks 24 and 25; 64 and 64' are guide ribs for the stopper 44; 65 and 65' are guide ribs for the stopper 45; 66 and 66' are guide ribs for the lock plate 51. These guide ribs are protrusively formed on the base 1*b*. One (66) of the guide ribs 66 and 66' functions as a receive-lock portion to which the pawl plate 58*a* strikes as shown also in FIG. 10 and prevents excessive rotation of the shutter 48. Reference numerals 67, 68, 69 and 70 represent upper surface support plates of the stoppers 44, 45, respectively, and reference numeral 71 represents an escape elongated hole bored on the driving rack 25.

As described above, in accordance with the present invention, it is possible to play the baseball game in the same way as in the real baseball game on the basis of the fielding contents and of the kinds of pitching and batting that are displayed on the rotary display disc and on the display drums, without using the real ball. Thus, the present invention provides a toy for playing the baseball game which offers a high level of interest to the players, is easy and economical to produce and is free from mechanical troubles.

What is claimed is:

1. A toy for playing a baseball game by players comprising: a main body of said toy and a cover member for covering said main body;

said main body including:

a first rotary member bearing on the outer surface thereof plural displays for displaying the kind of pitching in said baseball game and plural displays for displaying the kind of offense in said baseball game;

a second rotary member bearing on the outer surface thereof plural displays for displaying the kind of fielding in said baseball game;

driving means for rotating said first and second rotary members in the interlocking arrangement with each other;

first stopping means for stopping the rotation of said first rotary member; and second stopping means for stopping the rotation of said second rotary member; and said cover member including:

a first window allowing the players to see therethrough one display of said displays on said first rotary member for displaying the kind of pitching;

a second window allowing the players to see therethrough one display of said displays on said first rotary member for displaying the kind of offense; and a plurality of third windows, each allowing the players to see therethrough one display of said displays on said second rotary member.

2. The toy for playing the baseball as defined in claim 1 wherein said first rotary member is a rotary drum having a rotary axle, said rotary drum including a first drum equipped around the circumferential surface thereof in the rotating direction with said plural displays for displaying the kind of pitching with a predetermined pitch and a second drum equipped around the circumferential surface thereof in the rotating direction with said plural displays for displaying the kind of offense with said pitch; and said second rotary member is a disc having a rotary axle and equipped with said plural displays with a predetermined pitch along a concentric circle on the surface of said disc.

3. The toy for playing the baseball game as defined in claim 2 wherein said driving means includes: a slidable rack biased by a spring; first and second pinions engaging with said slidable rack, respectively; a first gear fixed coaxially on the same axle as that of said first pinion; a second gear fixed coaxially on the rotary axle of said rotary drum and engaging with said first gear; a third gear fixed coaxially on the same axle as that of said second pinion; a fourth gear fixed on the rotary axle of said disc and engaging with said third gear; and a lever connected operatively to said rack and actuating said rack against said spring.

4. The toy for playing the baseball game as defined in claim 3 wherein said first stopping means includes: a first slidable rod biased by a first spring; a first anchor member for anchoring said first rod at a predetermined position against said first spring; a first anchor-release member for releasing the anchor of said first rod by said first anchor member; and a first braking gear engaging with one end portion of said first rod released from the anchor and allowed to return by said first spring, having an engaging portion of the same pitch as said pitch of said display disposed on said rotary drums, and fixed onto the rotary axle of said rotary drums; and said second stopping means includes: a second slidable rod biased by a second spring; a second anchor member for anchoring said second rod at a predetermined pisition against said second spring; a second anchor-release member for releasing the anchor of said second rod by said second anchor member; and a second braking gear engaging with one end portion of said second rod released from the anchor and allowed to return by said second spring, having an engaging portion of the same pitch as said pitch of said displays disposed on said disc, and fixed to the rotary axle of said disc; said toy further including; a rotary arm connected operatively to said first and second rods, having the free end thereof connected operatively to said rack and the other end thereof pivoted to said main body.

5. The toy for playing the baseball game as defined in claim 4 wherein said first anchor member is an anchor plate engaging with said first rod and said first anchor-release member is a push button integrally formed with said anchor plate and biased by a spring towards said main body.

6. The toy for playing the baseball game as defined in claim 3 wherein said rack comprises a first rack biased by a stronger spring and a second rack biased by a weaker spring so as to normally strike said first rack.

7. The toy for playing the baseball game as defined in claim 4 wherein said second anchor member is an anchor plate engaging with said second rod and implanted onto said main body, and said second anchor-release member consists of a push rod coming into contact with said anchor plate and a push button coming into contact with said push rod.

8. The toy for playing the baseball game as defined in claim 2 wherein said second window is equipped with a shutter member capable of opening and closing said second window.

9. The toy for playing the baseball game as defined in claim 2, further including a shutter member capable of selectively opening and closing said first and second windows.

10. The toy for playing the baseball game as defined in claim 2 wherein said third window is disposed at the position corresponding to the position of each fielder in the baseball game.

* * * * *